US009224570B2

(12) United States Patent
Rao et al.

(10) Patent No.: US 9,224,570 B2
(45) Date of Patent: Dec. 29, 2015

(54) VACUUM ENCAPSULATED, HIGH TEMPERATURE DIAMOND AMPLIFIED CATHODE CAPSULE AND METHOD FOR MAKING SAME

(71) Applicant: Brookhaven Science Associates, LLC, Upton, NY (US)

(72) Inventors: Triveni Rao, Shoreham, NY (US); John Walsh, Sound Beach, NY (US); Elizabeth Gangone, New Hyde Park, NY (US)

(73) Assignee: Brookhaven Science Associates, LLC, Upton, NY (US)

( * ) Notice: Subject to any disclaimer, the term of this patent is extended or adjusted under 35 U.S.C. 154(b) by 287 days.

(21) Appl. No.: 13/896,459

(22) Filed: May 17, 2013

(65) Prior Publication Data

US 2013/0320295 A1 Dec. 5, 2013

Related U.S. Application Data

(60) Provisional application No. 61/648,632, filed on May 18, 2012.

(51) Int. Cl.

| | |
|---|---|
| ***H01J 9/12*** | (2006.01) |
| ***H01J 29/02*** | (2006.01) |
| ***H01J 29/48*** | (2006.01) |
| ***H01J 3/02*** | (2006.01) |
| ***H01J 5/26*** | (2006.01) |
| ***H01J 9/26*** | (2006.01) |

(52) U.S. Cl.

CPC ..... *H01J 29/023* (2013.01); *H01J 3/021* (2013.01); *H01J 5/26* (2013.01); *H01J 9/125* (2013.01); *H01J 9/26* (2013.01); *H01J 29/485* (2013.01); *Y10T 29/41* (2015.01)

(58) Field of Classification Search

CPC ..... H01J 9/125; H01J 9/26; H01J 43/28; H01J 29/023; H01J 29/481; H01J 29/485; H01J 3/021; H01J 3/022; H01J 5/26

See application file for complete search history.

(56) References Cited

U.S. PATENT DOCUMENTS

| | | | | |
|---|---|---|---|---|
| 5,473,218 | A | 12/1995 | Moyer | |
| 6,060,839 | A | 5/2000 | Sverdrup, Jr. et al. | |
| 6,323,594 | B1 | 11/2001 | Janning | |
| 7,227,297 | B2 | 6/2007 | Srinivasan-Rao et al. | |
| 7,601,042 | B2 | 10/2009 | Srinivasan-Rao et al. | |
| 8,922,107 | B2 * | 12/2014 | Rao et al. | 313/399 |

* cited by examiner

*Primary Examiner* — Anh Mai
*Assistant Examiner* — Steven Horikoshi
(74) *Attorney, Agent, or Firm* — Dorene M. Price

(57) ABSTRACT

A vacuum encapsulated, hermetically sealed cathode capsule for generating an electron beam of secondary electrons, which generally includes a cathode element having a primary emission surface adapted to emit primary electrons, an annular insulating spacer, a diamond window element comprising a diamond material and having a secondary emission surface adapted to emit secondary electrons in response to primary electrons impinging on the diamond window element, a first high-temperature solder weld disposed between the diamond window element and the annular insulating spacer and a second high-temperature solder weld disposed between the annular insulating spacer and the cathode element. The cathode capsule is formed by a high temperature weld process under vacuum such that the first solder weld forms a hermetical seal between the diamond window element and the annular insulating spacer and the second solder weld forms a hermetical seal between the annular spacer and the cathode element whereby a vacuum encapsulated chamber is formed within the capsule.

8 Claims, 5 Drawing Sheets

VACUUM ENCAPSULATED, HIGH TEMPERATURE DIAMOND AMPLIFIED CATHODE CAPSULE AND METHOD FOR MAKING SAME

CROSS-REFERENCE TO RELATED APPLICATIONS

This application claims the benefit of U.S. Provisional Application No. 61/648,632, filed on May 18, 2012, the specification of which is incorporated by reference herein in its entirety for all purposes.

STATEMENT OF GOVERNMENT LICENSE RIGHTS

This invention was made with Government support under contract number DE-AC02-98CH10886, awarded by the U.S. Department of Energy. The Government has certain rights in the invention.

FIELD OF THE INVENTION

The present electron generating cathode is generally for use in an electron gun and relates more particularly to a vacuum encapsulated, hermetically sealed high temperature diamond amplified cathode capsule and an efficient, non-contaminating method for making same.

BACKGROUND

Electron guns are used to generate a directed stream of electrons with a predetermined kinetic energy. Electron guns are most commonly used to generate electron beams for vacuum tube applications such as cathode ray tubes (CRTs) found in televisions, game monitors, computer monitors and other types of displays.

Many medical and scientific applications require the generation of electron beams as well. Electron guns provide the electron source for the generation of X-rays for both medical and scientific research applications, provide the electron beam for imaging in scanning electron microscopes, and are used for microwave generation, e.g., in klystrons.

In many cases, the electron gun is incorporated into a linear accelerator system, or LINAC. LINACs have many industrial applications, including radiation therapy, medical and food product sterilization by irradiation, polymer cross linking and nondestructive testing (NDT) and inspection.

In addition, an electron gun is a key component of the injector system of many high-energy particle accelerator systems. The creation of high average-current, high brightness electron beams is a key enabling technology for these accelerator-based systems, which include high-energy LINACs, such as Energy-Recovery LINAC (ERL) light sources, electron cooling of hadrons , high-energy ion colliders, and high-power free-electron lasers (FELs). For these applications, the electron gun generates and provides a charged particle beam for input to the accelerator. The output of the accelerator system is an accelerated beam at the energy required for the particular application.

An electron gun, also referred to as an injector, is composed of at least two basic elements: an emission source and an accelerating region. The emission source includes a cathode, from which the electrons generated in the emission source escape. The accelerating region accelerates the electrons in the presence of an electric field to an accelerating electrode (anode), typically having an annular shape, through which the electrons pass with a specific kinetic energy. The commonly known cathodes used in electron guns generate electrons either by thermionic emission, field emission, or photoemission.

Photoemission cathodes typically generate a large number of electrons by photoemission from a laser-illuminated photocathode. The accelerated electrons typically enter an accelerating structure to reach higher energy. A high-current electron beam is thus generated at an output port of the injector of a high-power accelerator.

Very high average current electron injectors are required for a number of applications. The amplitude of the current is determined by the quantum efficiency (QE) of the cathode and the power of the laser beam available. Hence, the obvious choice for these applications is a high QE cathode irradiated by the highest power of the laser available. However, there are inherent problems with this approach. The high QE cathodes are typically sensitive to contamination and thus have very limited lifetime. Furthermore, the commercially available lasers do not have enough power to deliver the average currents required from these cathodes for some of these applications.

A reliable, efficient, long-life high power laser and photocathode combination capable of generating high-current low-emittance electron beams has recently been disclosed in commonly owned U.S. Pat. Nos. 7,227,297 and 7,601,042 to Srinivasan-Rao et al., ("the Srinivasan-Rao patents"), the specifications of which are incorporated herein by reference in their entireties for all purposes. The electron gun device disclosed in these patents includes a secondary emitter that emits secondary electrons in response to receiving a beam of primary electrons. In one mode, the primary beam of electrons is generated by photoemission from the photocathode in response to a laser beam striking the photocathode.

In one embodiment, the Srinivasan-Rao patents propose using an encapsulated secondary emission enhanced cathode device, which contains the photocathode and the secondary emitter in a vacuum within a housing. The photocathode includes a primary emission surface adapted to emit primary electrons from the primary emission surface. The housing defines a drift region through which the primary electrons are accelerated to a desired energy. The secondary emitter has a secondary emission surface that has negative-electron-affinity. The secondary emission surface emits secondary electrons in response to primary electrons impinging on the secondary emitter.

The Srinivasan-Rao patents further disclose use of one of single crystal diamond, polycrystalline diamond, and diamond-like carbon for the non-contaminating secondary emitter. It has been found that such a diamond amplified photocathode can perform multiple functions: 1) It amplifies the primary current from a conventional photocathode with amplification factors exceeding 200, thereby reducing the demands on the primary cathode and the laser; and 2) It also acts as a window that isolates the cathode from the RF cavity, thereby shielding them from contaminating each other.

However, while the general concept of an encapsulated secondary emission enhanced cathode device has been proposed, attempts to successfully commercially fabricate such devices have proven quite difficult and a specific optimum structure for such a device has heretofore been unknown.

Accordingly, it would be desirable to provide an encapsulated secondary emission enhanced cathode device for use in an electron gun, which is easily and reliably manufactured. It would be further desirable to provide such a cathode device having an optimum non-contaminating structure, which permits simple and reliable manufacture and which will efficiently operate in superconducting RF electron guns for the generation of high-current high-brightness electron beams.

SUMMARY

The present invention is a vacuum encapsulated, hermetically sealed high temperature cathode capsule for generating an electron beam of secondary electrons. The capsule generally includes a cathode element having a primary emission surface adapted to emit primary electrons, an annular insulating spacer, a diamond window element comprising a diamond material and having a secondary emission surface adapted to emit secondary electrons in response to primary electrons impinging on the diamond window element, a first high temperature solder weld disposed between the diamond element and the annular insulating spacer and a second high temperature solder weld disposed between the annular insulating spacer and the cathode element. The present cathode capsule of the present invention is formed by a high-temperature weld process under vacuum such that the first solder weld forms a hermetical seal between the diamond window element and the annular insulating spacer and the second solder weld forms a hermetical seal between the annular spacer and the cathode element whereby a vacuum encapsulated chamber is formed within the capsule.

In a preferred embodiment, the first and second solder welds are made with a material comprising 96.8 gold (Au)/3.2 silicon (Si). Also, the cathode element, the diamond window element and the annular insulating spacer preferably have interface surfaces coated with a metallic wetting material, wherein the metallic wetting material is in contact with one of the first and second solder welds to promote atomic adhesion therebetween. With 96.8 Au/3.2 Si solder blanks, use of a gold (Au) wetting material is preferred.

In one embodiment, the cathode element may be formed from a gallium nitride (GaN) base grown on a sapphire substrate and the wetting material may take the form of a gold material vacuum sputtered on an outer peripheral rim of the gallium nitride base. However, it is conceivable that the device can accommodate other cathode materials as well.

A method for fabricating a diamond amplified cathode capsule for generating an electron beam of secondary electrons is also described. The present method generally includes the steps of providing a cathode element having a primary emission surface adapted to emit primary electrons, providing an annular insulating spacer, providing a diamond window element comprising a diamond material and having a secondary emission surface adapted to emit secondary electrons in response to primary electrons impinging on the diamond window element, stacking a first high temperature solder blank between the diamond window element and the annular insulating spacer, stacking a second high temperature solder blank between the annular insulating spacer and the cathode element and welding the cathode element, the annular insulating spacer, the diamond window element and the first and second solder blanks under vacuum. The welding process is performed in a manner such that the first solder blank forms a hermetical weld seal between the diamond window element and the annular insulating spacer and the second solder blank forms a hermetical weld seal between the annular spacer and the cathode element, whereby a vacuum encapsulated chamber is formed within the capsule.

In an exemplary embodiment, the present method of the present invention further includes the steps of coating interface surfaces of the cathode element, the annular insulating spacer and the diamond window element with a metallic wetting material. During welding, the metallic wetting material contacts the first and second solder blanks to promote atomic adhesion therebetween. Preferably, the metallic wetting material is coated on the interface surfaces by a vacuum sputtering process, although other techniques can be used.

The process of providing the diamond window element preferably includes forming a diamond base, metalizing one face of the diamond base and vacuum sputtering a gold wetting material on an outer peripheral rim of the diamond base to form a gold coated diamond base.

To precisely align the components of the cathode capsule, and to ensure that the diamond element is protected from contamination during the high temperature welding process, the method of the present invention further preferably includes a two step welding process, wherein the diamond element, the first solder blank and the insulating spacer are stacked and welded in a first step, and the welded diamond and spacer assembly is subsequently stacked with the cathode element and the second solder blank in an alignment locking mechanism, which seals the diamond element during welding in a second step.

The preferred embodiments of the vacuum encapsulated hermetically sealed diamond amplified cathode capsule and the method for making same, according to the present invention, as well as other objects, features and advantages of this invention, will be apparent from the following detailed description, which is to be read in conjunction with the accompanying drawings. The scope of the invention will be pointed out in the claims.

DETAILED DESCRIPTION

Figure 1:
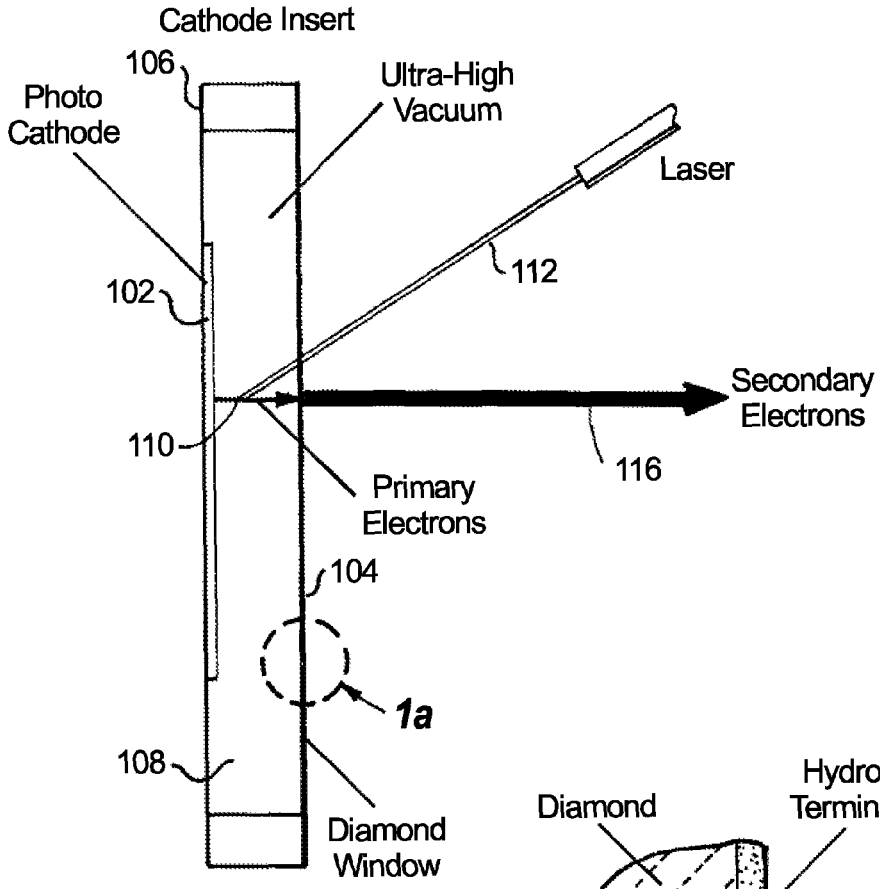
Fig. 1 (Prior Art)
FIG. 1 is a schematic side view of a cathode insert according to the prior art.
Figure 1A:
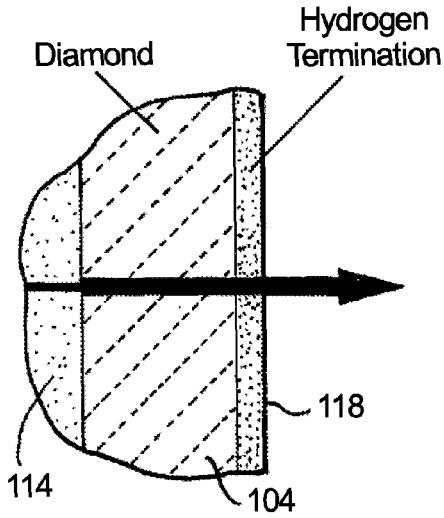
Fig. 1a (Prior Art)
FIG. 1*a* is an enlarged side view of the diamond window shown in FIG. 1.

FIGS. 1 and 1*a* show the general schematic structure of a prior art diamond amplified cathode insert 100, as described in U.S. Pat. Nos. 7,227,297 and 7,601,042 to Srinivasan-Rao et al. The cathode insert generally includes a cathode element 102 and a diamond window 104 provided under vacuum in a housing 106. The housing defines a drift region 108, across which the primary electrons are accelerated to a desired energy to the input surface of the window 104 by an electric field. The cathode 102 shown in FIGS. 1 and 1*a* is in the form of a photocathode, which generates primary electrons 110 in response to an incident laser beam 112. However, as discussed in the Srinivasan-Rao patents, the invention described therein is also well suited to field emission and thermionic emission type cathodes.

The diamond window 104, also termed the secondary emitter, includes a non-contaminating negative-electron-affinity material and emits secondary electrons 116 in response to the incident primary electrons 110. Primary electrons 110 are received at an input surface 114 of the secondary emitter 104 and secondary electrons 116 are emitted from an emitting surface 118.

The input surface 114 of the diamond emitter 104 is a substantially uniform electrically conductive layer, which serves as an electric conductor to bring a replenishing current to the emitter. The emitting surface 118 has an enhanced negative-electron-affinity (NEA) material, which forms an outer layer of the window. The diamond dangling bonds are terminated by hydrogen to provide the enhanced NEA surface of the diamond. Secondary electrons are generated by the diamond in response to the primary electrons, and are emitted from the device through the NEA surface.

Thus, the '297 and '042 patents to Srinivasan-Rao et al. disclose a conceptual design for a diamond enhanced cathode insert, but an optimum structure for such a device and a method of manufacturing such a device has heretofore been unknown.

Figure 2:
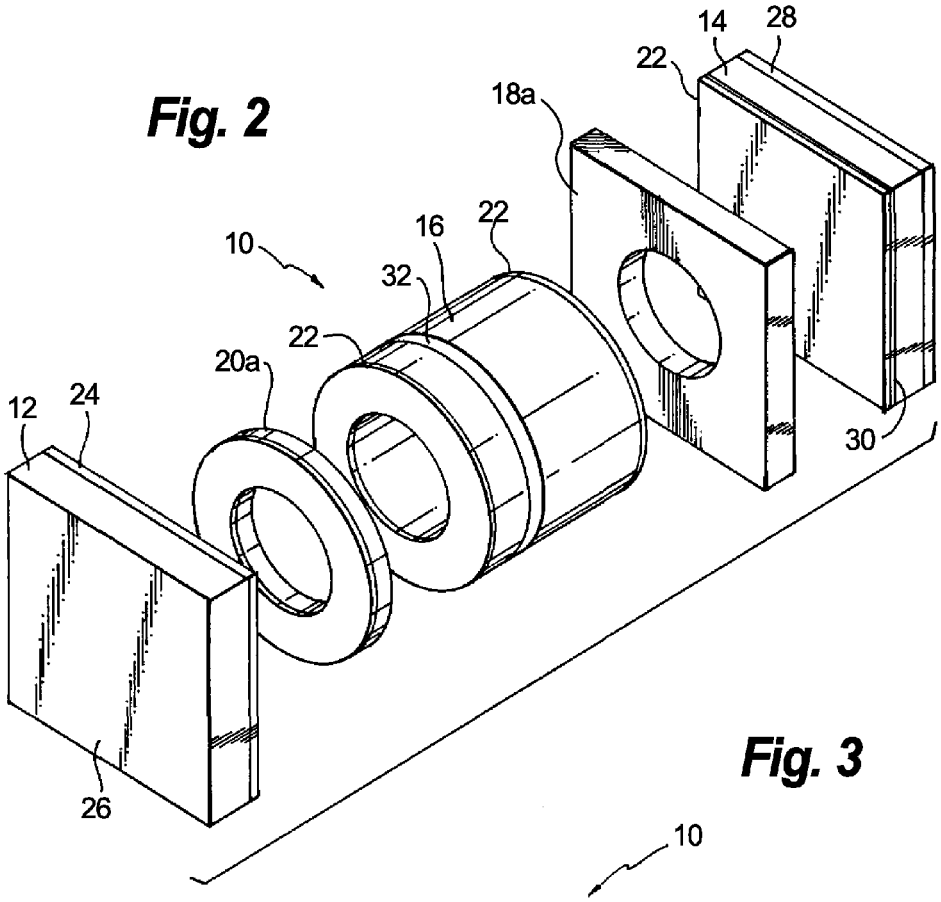
FIG. 2 is a is an exploded perspective view of the vacuum encapsulated, hermetically sealed, diamond amplified cathode capsule formed in accordance with the present invention.
Figure 3:
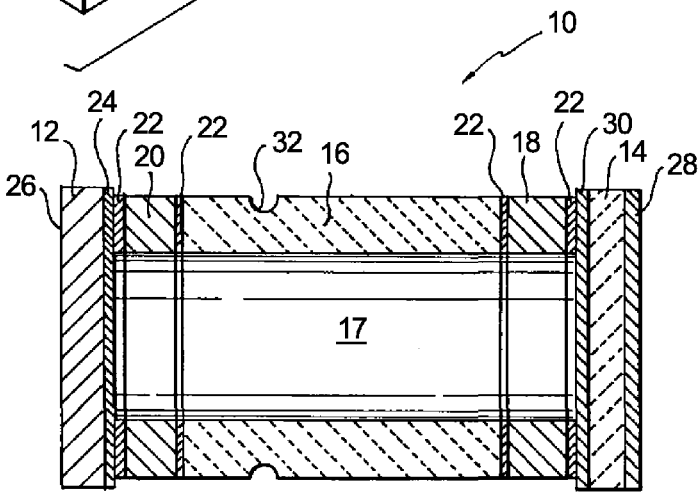
FIG. 3 is a cross-sectional view of the vacuum encapsulated, hermetically sealed, diamond amplified cathode capsule shown in FIG. 2.

Turning now to FIGS. 2 and 3, a present vacuum encapsulated, hermetically sealed diamond amplified cathode capsule 10 according to the present invention is shown. The capsule 10 generally includes a cathode element 12 and a diamond window element 14 separated by an insulating spacer 16. As will be discussed in further detail below, the cathode element 12, the insulating spacer 16 and the diamond window element 14 are hermetically sealed together to form a capsule 10 having a vacuum encapsulated chamber 17 defined therein.

As will also be discussed in further detail below, the cathode element 12, the insulating spacer 16 and the diamond window element 14 are fixed together utilizing a high-temperature welding process. Accordingly, a first solder weld 18 is formed between the diamond window element 14 and the insulating spacer 16 and a second solder weld 20 is provided between the insulating spacer 16 and the cathode element 12, as shown in FIG. 3. As will also be discussed in further detail below, the first solder weld 18 is formed from a first solder blank 18*a* and the second solder weld 20 is formed from a second solder blank 20*a*.

To promote atomic adherence, the surfaces of the cathode element 12, the insulating spacer 16 and the diamond window element 14 that are in contact with the solder welds 18, 20 are coated with a metallic wetting material 22. In a preferred embodiment, the wetting material 22 is gold, which is preferably sputtered on the interface surfaces of the cathode element 12, the insulating spacer 16 and the diamond window element 14, as will be discussed in further detail below The cathode element 12 is in the form of a rectangular or circular disk and can be made from any cathode material known in the art. Cathode materials that can be used in the cathode insert include metals, such as copper, magnesium and lead. When forming a photocathode, high quantum efficiency photo-emissive materials, which include cesium potassium antimonide ($CsK_2Sb$), metals, multialkali, alkali telluride, alkali antimonide, multialkali antimonide, and cesiated semiconductor can be used.

In a preferred embodiment, the cathode material used is gallium nitride (GaN) (Mg doped at a concentration of about $1\times10^{19}$ $cm^{-3}$). The gallium nitride base 24 is preferably in the form of a film about 1 cm×1 cm square and has a thickness of about 0.1 μm. The GaN base 24 is preferably grown via Molecular Beam Epitaxy on top of a 1 cm×1 cm×0.3 mm thick sapphire substrate 26.

The diamond window element 14 is made from diamond materials as described above with respect to the prior art. Preferably, the diamond window element 14 is made from a single crystal diamond hydrogenated to produce a negative-electron-affinity material 28 serving as the electron emitting surface. The diamond window element 14 further includes a uniform electrically conductive layer 30, which serves both as an electron input surface, as well as an electric conductor to bring a replenishing current to the emitter.

The diamond element 14 is preferably a 4 mm×4 mm square of chemical vapor deposition (CVD) grown single crystal with less than 1 ppb nitrogen content and having a thickness of about 150-300 microns. A 3 mm diameter circle, centered on one face of the diamond is metalized with 30 nm of Pt and the opposite face is hydrogenated. As will be discussed in further detail below, 50 nm of gold (Au) is sputtered from the 3 mm diameter Pt section to the edges of the diamond as a wetting material. Also, the sides of the diamond element 14 must be masked off during this step.

The insulating spacer 16 has an annular or ring-like form and is preferably made from an alumina, ceramic or any other insulating material known in the art. The spacer preferably has an outer diameter of about 0.23", an inner diameter of about 0.11" and a length of about 0.15" mm, with the central bore extending the full length of the spacer. The spacer 16 further preferably includes an annular groove 32 formed in its outer radial surface to act as a thermal break during the soldering process, as will be discussed in further detail below. The opposite axial faces of the spacer 16 are also preferably coated with a nickel plating on top of MoMn metallization.

It has been found that one of the preferred materials for the high temperature first and second solder blanks 18*a* and 20*a* is 96.8 gold (Au)/3.2 silicon (Si) due to its ability to withstand the temperatures reached during reheating of the hydrogenated diamond to restore gain. A suitable solder blank material for use in the present invention is supplied as a 1"×1"×0.002" ribbon by Indium Corporation of America under the trade name Indalloy 184.

The first solder blank 18*a*, which will form the first solder weld 18 between the diamond element 14 and the spacer 16 preferably has a generally square shape with sides measuring about 4 mm. The first solder blank 18*a* further has a 0.12" diameter aperture punched through its middle and a thickness of about 0.002". The second solder blank 20*a*, which will form the second solder weld 20 between the spacer 16 and the cathode element 12 preferably has an annular shape with an outer diameter of about 0.25" and an inner diameter of about 0.13". The thickness of the second solder blank 20*a* is also about 0.002".

With Au/Si solder blanks, 18*a*, 20*a*, the preferred wetting material 22 is gold (Au). However, other wetting materials, which will ensure strong adhesion with the high temperature solder blanks can be used.

In the embodiments shown in FIGS. 2 and 3, the cathode element 12, the diamond window element 14 and the insulating spacer 16 are shown with the wetting material 22 applied on the outer peripheral rims or edges thereof. The wetting material 22 can be applied in this embodiment by masking the center of the cathode element 12, the diamond window element 14 and the insulating spacer 16 and vacuum sputtering the gold wetting material on the outer rims of these components.

Having described the individual components of the vacuum encapsulated, hermetically sealed diamond amplified cathode capsule 10, a method for fabricating this device according to the present invention will now be described. In general, the capsule 10 is made using a high temperature welding process in a manner that will vacuum encapsulate the components to protect the sensitive cathode material. The present invention provides a method for assembling these components under vacuum to form a hermetically sealed capsule.

The constraints on the process and the capsule are: 1) The process should be able to accommodate laser cleaning of the cathode 12 and vacuum baking of the diamond 14 prior to assembly; 2) The ultimate capsule 10 should be able to handle a temperature range of +350° C. (bake out temperature of diamond) to −200° C. (operating temperature in SRF injector) without losing the internal vacuum; and 3) The process should also be compatible with the fabrication of sensitive cathodes such as $K_2CsSb$. The process described below meets these constraints.

Preparation of the GaN cathode first involves the steps of etching the cathode element 12 with a piranha solution to remove contaminants and rinsing the element with distilled water. It is then transported submerged in the distilled water and dried by exposing it to flowing dry nitrogen gas prior to use. The rim of the GaN cathode element 12 from the outer edges to an inner diameter of 3 mm is then sputtered with 50 nm Au, leaving the center unaltered. This leaves a ring of 6 mm outer diameter and 3 mm inner diameter of sputtered wetting material on the cathode element 12.

As mentioned above, the diamond element 14 is prepared by sputter coating one surface with 50 nm Au, while sputter coating 30 nm Pt in a 3 mm diameter in the center. The opposite surface is hydrogenated.

The spacer 16 is prepared by first lightly circularly buffing the metalized ceramic surfaces with 600 grit SiC paper until the oxidized layer has been removed and appears bright. The spacer is then etched in a 4:1 water:HCl solution for 5 minutes, (on its side, not joining surfaces, to remove surface oxidation and contamination. The spacer 16 is then immediately placed in an acetone bath after etching. Each metalized surface is then sputter coated with 50 nm Au while masking off the entire inner diameter and outer surfaces.

The solder blanks 18*a* and 20*a* are prepared by circularly sanding each side with 600 grit SiC paper until the oxidized layer has been removed. The blanks are then cleansed in an acetone bath.

As mentioned above, the components are assembled using a two step high temperature soldering process. The first step involves the soldering of the diamond element 14 to one side of the ceramic spacer 16 in vacuum with trace amounts of hydrogen flowing. The second step involves soldering the GaN cathode element 12 to the other side of the ceramic spacer 16 in high vacuum.

To accomplish this, a brazing chamber fabricated from ultra-high vacuum (UHV) components is utilized. The brazing chamber preferably consists of a button heater with its top surface inside a 2¾" cube. As will be described in further detail below, the brazing chamber further preferably includes a ram and a modified angle valve including an alignment device with a two-stage spring locking mechanism, which is able to apply pressure to the alumina spacer 16, while sealing the hydrogenated side of the diamond 14 from contamination during the second soldering step. The locking mechanism further preferably includes a clamp member, which also acts as a heat sink, attached to both the alumina spacer 16 and the alignment locking mechanism, and does not allow for the top soldered joint to melt again during the second step of the soldering process. The chamber is further preferably pumped by a scroll/turbo pump combination and ion pump.

Figure 4:
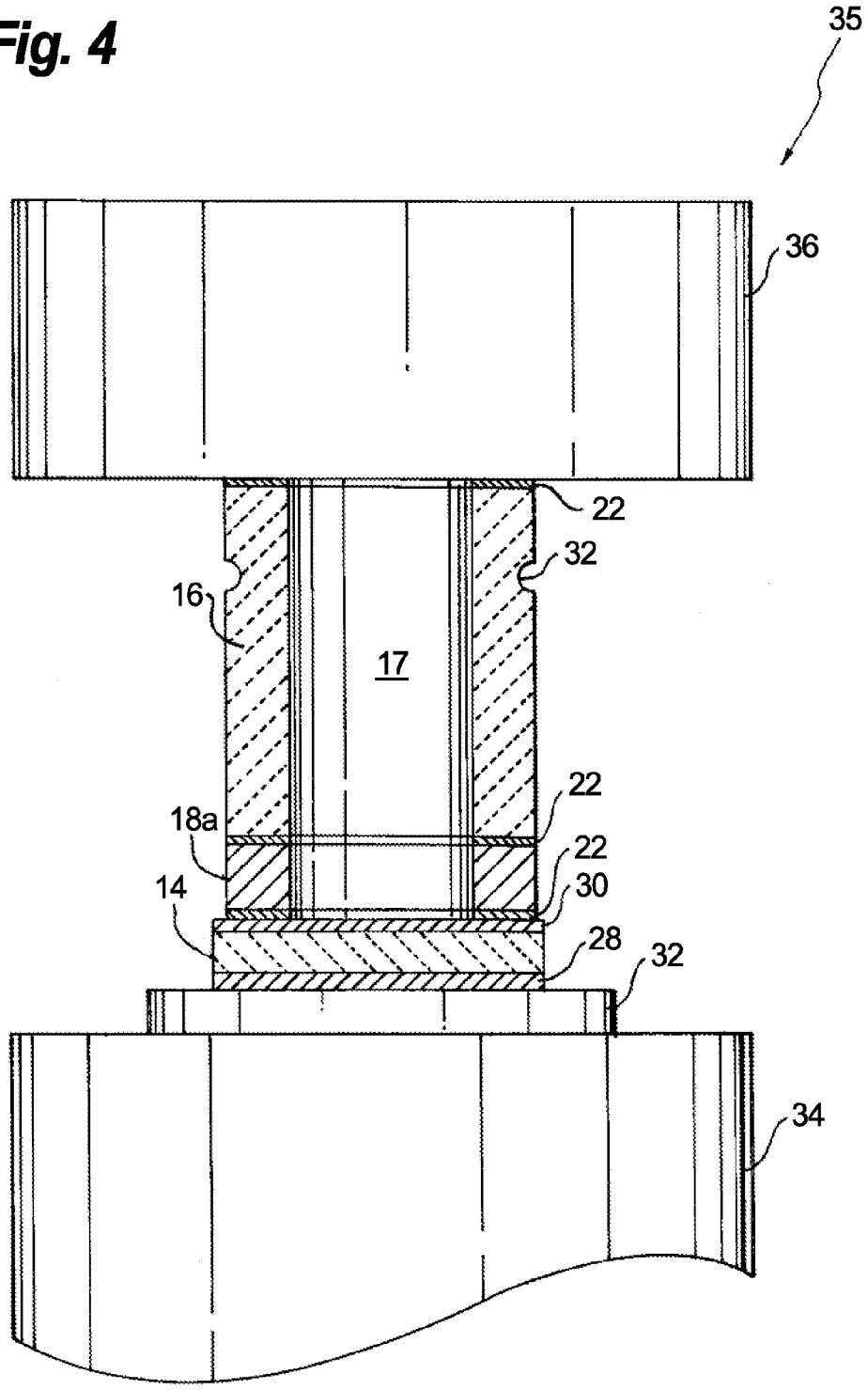
FIG. 4 is a cross-sectional view showing the first step of the two step soldering process of the present invention.

Turning now to FIG. 4, the soldering process starts with the soldering of the metalized side 22 of the diamond element 14 to the metalized flat face 22 of the ceramic spacer 16. The diamond element 14 is placed metalized face 22 upwards on a clean "dummy" diamond or sapphire washer 32 on top of the button heater 34 of the brazing chamber 35 to protect the hydrogenated surface 28. The AuSi square solder blank 18*a* and the ceramic spacer 16 are then stacked, in that order, on top of the diamond element, followed by a 50 g weight 36 on the ceramic spacer 16.

When soldering the diamond to the alumina, the brazing chamber 35 is pumped to at least $10^{-7}$ torr. The brazing chamber can be pumped down with a scroll pump for 5 min, followed by a turbo pump. Hydrogen is then leaked into the system at a rate that approximately equals the pumping rate, so the system is at equilibrium. The hydrogen can be slowly introduced into the brazing chamber 35 through a leak valve to raise the pressure by only one order of magnitude to protect the diamond 14 from the contaminants released due to solder outgas.

Once the chamber has been evacuated, the heating of the button heater starts. Current is passed through the button heater 34 to heat it for an hour. Preferably, a current controlled power supply is used to slowly ramp up current from 2.5 A to 3.25 A while taking 0.25 A steps every 20 min. Soldering takes place when the button heater 34 reaches 370° C. The temperature of the solder should reach approximately 370° C. after about 2 hours and should soak at maximum temperature for 1 hour.

The current is then turned off and the chamber is cooled. Once the button heater reads below 30° C., $N_2$ gas is bled into the chamber and the vacuum system is opened to complete the first step of the soldering process.

Figure 5:
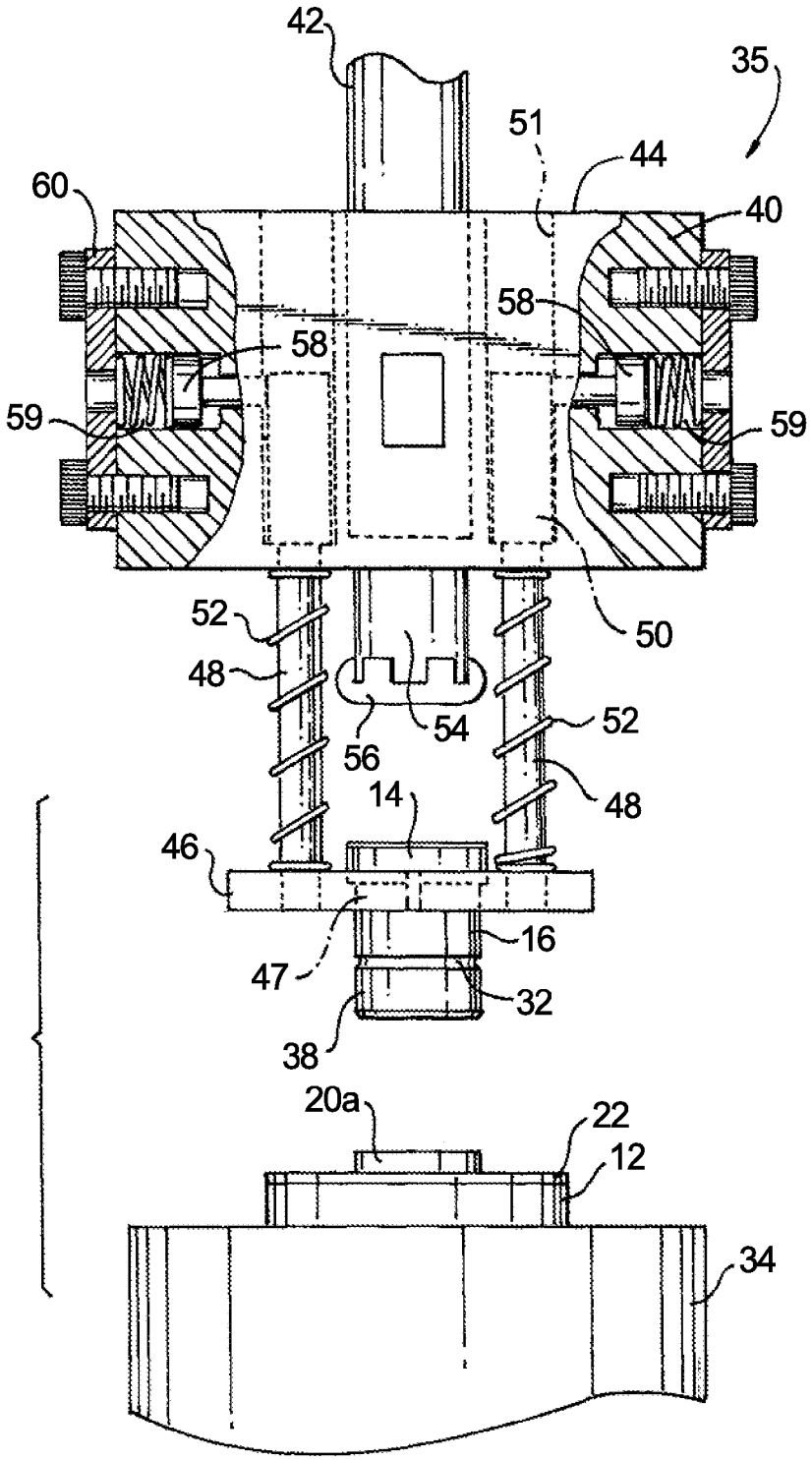
FIG. 5 is a side view illustrating the second step of the two step soldering process of the present invention with the spring-lock mechanism of the present invention shown in an extended position.
Figure 6:
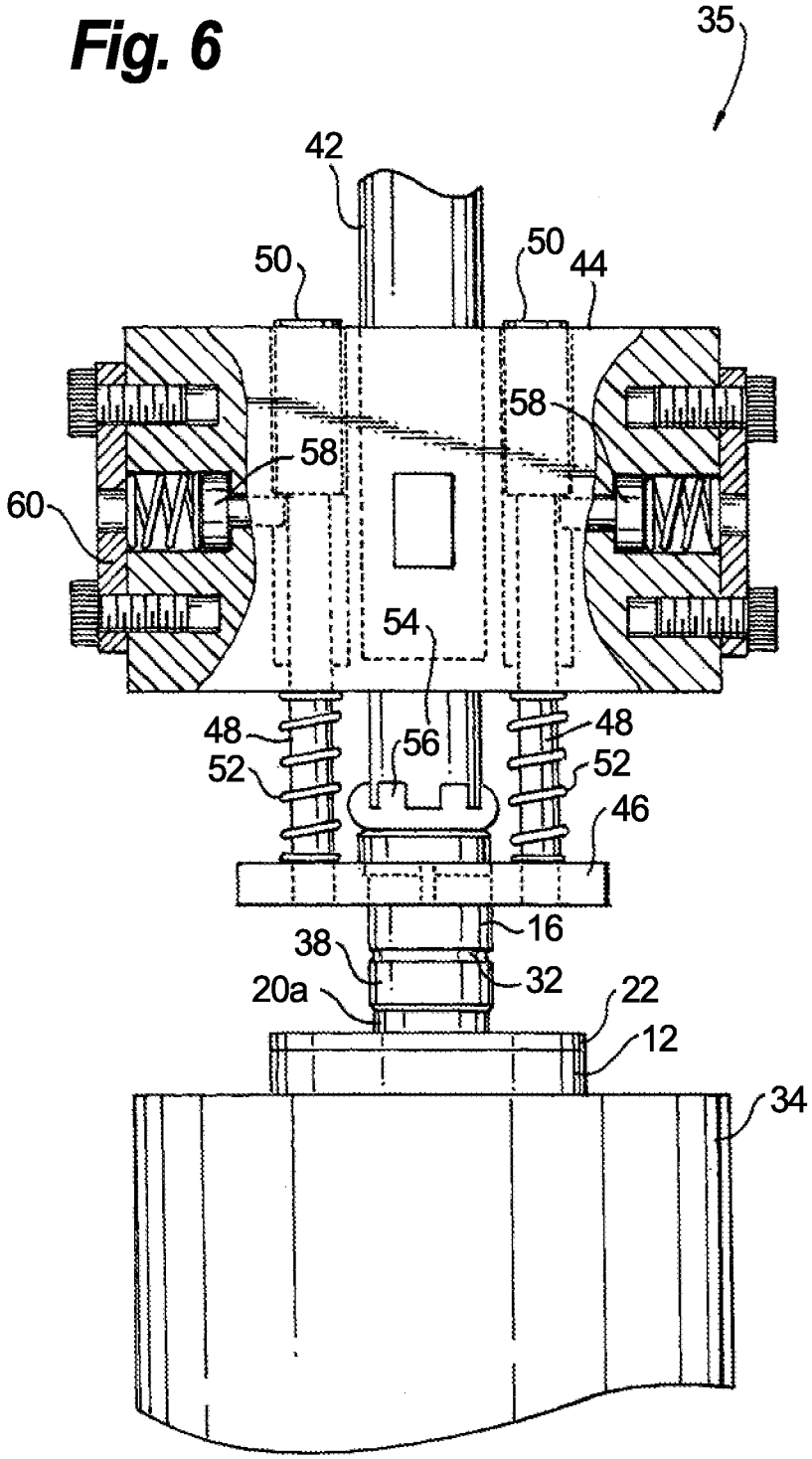
FIG. 6 is a side view illustrating the second step of the two step soldering process of the present invention with the spring-lock mechanism of the present invention shown in a retracted position.

Turning now to FIGS. 5 and 6, the second step of the soldering process begins by loading the welded diamond and ceramic unit 38 into a specially designed alignment device including a spring lock mechanism 40 fixed to the ram 42 of the brazing chamber 35. The spring lock mechanism 40 includes a collar 44 defining a central bore for receiving the end of the ram 42. The collar 44 can be fixed to the ram 42 in any conventional manner.

The spring lock mechanism 40 further includes a movable annular clamp member 46 attached to the collar 44 via two retractable arms 48. The clamp member 46 defines a bore 47 for retaining the welded diamond and ceramic unit 38, as will be described in further detail below. The clamp member 46 is attached to the collar 44 by the retractable arms 48 in a manner that the bore 47 will be axially aligned with the ram 42. The clamp member 46 is also preferably designed to provide both a heat sink, as well as a clamping force on the welded diamond and ceramic unit 38. This can be achieved by designing the clamping member 46 in the form of a collapsible ring in which a screw mechanism is utilized to adjust the diameter of the inner bore 47.

The retractable arms 48 are formed with radially enlarged head portions 50, which are received within correspondingly sized apertures 51 in the collar 44. The head portions 50 of the retractable arms 48 are retained within the collar 44 in a movable manner so as to permit the clamp member 46 to move up and down in an axial direction with respect to the axis of the ram 42. Each retractable arm 48 is preferably provided with coil springs 52 trapped between the collar 44 and the clamp member 46 for biasing the clamp member 46 in an extended position away from the collar.

The spring lock mechanism 40 further includes a sealing element support shaft 54 extending in the axial direction away from the collar 44 between the retractable arms 48. The sealing element support shaft 54 is axially aligned with the ram 42 and the central bore 47 of the clamp member 46. Supported at the end of the shaft 54 is a sealing element 56, which is preferably in the form of a Kalrez® O-ring.

The spring lock mechanism 40 further includes at least one locking pin 58 assigned to at least one of the retractable arms 48. The locking pin 58 is movably received within a transverse bore 59 formed in the collar 44, which communicates with the axial bore 51 retaining the head portion 50 of the retractable arm 48. The locking pin 58 is preferably spring biased in a direction perpendicular to the direction of movement of the retractable arms 48 and can be held captured within the collar 44 by a plate and fastener arrangement 60.

When the retractable arms 48 are in their extended position, the locking pin 58 engages the outer peripheral surface of the head portion 50 of the arm. As the retractable arm 48 retracts within the collar 44, the head portion 50 of the arm moves out of engagement with the locking pin 58, which causes the locking pin to move inwardly into the retractable arm receiving bore under the bias of the spring. Once the locking pin 58 moves into the bore 51, it effectively locks the head portion 50 of the retractable arm, thereby locking the clamping member 46 into an upward retracted position. When the clamping member 46 is in such position it is in close proximity to the O-ring 56 held by the support shaft 54.

Operation of the spring lock mechanism will now be described with reference to FIGS. 5 and 6. The welded diamond and ceramic unit 38 is loaded into the clamp member 46 of the spring lock mechanism 40 with the ceramic spacer end 16 facing down toward the button heater 34 and the diamond end 14 facing up toward the O-ring 56. The ceramic spacer portion 16 of the welded unit 38 is then clamped in the central bore 47 of the movable clamp member 46 of the spring lock mechanism 40, which also serves as a heat sink for drawing heat away from the diamond element 14 during the second solder step.

The GaN cathode element 12 is placed on the button heater 34 with the AuSi ring 20*a* on top of the Au wetting material 22 and both are lined up so that they are directly below the ceramic/diamond unit 38 held in the clamping member 46 of the spring lock mechanism 40. The ram 42, together with the locking mechanism 40 is then carefully lowered so that the ceramic spacer 16 makes contact with the AuSi ring 18*a*. Further lowering of the locking mechanism 40 at this point will cause the retractable arms 48 to retract within the collar 44, thereby bringing the clamping member 46, as well as the welded unit 38 retained therein, closer to the O-ring 56. The retractable arms 48 are further retracted to a point where the diamond element 14 of the welded unit 38 is pressed into the O-ring, so as to seal-off the diamond from the surrounding environment, as shown in FIG. 6.

Shortly after the diamond element 14 is sealed off by the O-ring 56, further retraction of the retractable arms 48 causes the locking pin 58 to lock the head portions 50 of the arms within the collar. In particular, the locking pin 58 slips underneath the radially enlarged head portion 50 of the retractable arm 48 due to the pressure from the springs within the mechanism 40 and the retractable arms 48 are unable to move downward again. As a result, the clamp member 46 is locked in a retracted position whereby the diamond element 14 is sealed off by the O-ring.

Once the diamond is sealed off from its immediate surrounding environment, the button heater is preferably supplied with 2.5-3 A such that the button heater temperature is slightly higher than the chamber temperature, so as to degas the GaN cathode element 12 with AuSi solder 20*a*. After the pressure is in the low $10^4$ ton range, the button heater is turned off. Once cooled to room temperature (20° C.), pressure should be at least about $10^{-9}$ ton in the chamber. The brazing chamber 35 is then sealed and pumped for about 5 minutes, followed by a turbo pump. After the brazing chamber 35 reaches an ultimate pressure of $10^{-9}$ ton, an ion pump is turned on when the current draw is below 1.5 mA. The turbo pump is then valved off.

With the diamond element 14 sealed off by the Kalrez® O-ring 56, as shown in FIG. 6, the ram 42 is raised again so that the ceramic spacer 16 is lifted off of the cathode element 12. Thus, degassing of the AuSi solder 20*a* on the GaN cathode 12 occurs while the diamond element 14 is sealed, and before the ceramic spacer 16 is again lowered. The ram 42 is then again lowered and soldering occurs after degassing of the AuSi solder on the GaN cathode 12.

The soldering process preferably takes place by slowly increasing the current on the current controlled power supply by 0.25 A every 20-30 min from 2.5 A to 4.0 A until the temperature on the button heater reads 370° C. At this point, the second AuSi solder blank 20*a* will just begin to melt and degas again to form the second wet solder weld 20. The chamber is then slightly cooled down below the melting point (300° C.) after it is finished degassing (pressure back to ~$10^{-9}$ torr). At this point, the welded spacer/diamond unit 38 is lowered onto the solidified solder weld 20 and the current is adjusted so that the button heater reaches 370° C. and again melts the AuSi solder 20.

As can be appreciated, during the second welding step, the clamping member 46 holding the ceramic spacer 16 acts as a heat sink to draw heat from the button heater 34 away from the already formed weld joint between the diamond 14 and the spacer 16. Also, the annular groove 32 formed in the spacer 16 acts as a thermal break to prevent heat from the heater to travel to the weld joint between the diamond 14 and the spacer 16.

The second soldering step is completed by preferably soaking the chamber for about one hour and the current is set to 0 A to cool down the heater. Once the temperature is below 30° C., $N_2$ is slowly introduced into the chamber and the completed capsule 10 is removed.

Thus, the first step in the soldering process attaches the metalized side of the diamond to one metalized side of the alumina. As shown in FIG. 4, the stack (from bottom to top on the button heater) is a dummy diamond or sapphire washer 32 (so the hydrogenated surface is not face down touching another surface), diamond 14, AuSi solder 18*a*, alumina 16, and a weight 36. The second step uses the locking mechanism to both lower the alumina 16 onto the cathode 12 for soldering and also sealing off the diamond 14 to prevent contamination from outgassing. This time, as shown in FIG. 6, the button heater 34 has stacked (from bottom to top) the GaN cathode 12 and AuSi solder 20*a*. The alumina 16 with diamond 14 attached is sitting in the locking mechanism 40 in the choker style heat sink 46.

The capsule 10 of the present invention is particularly well suited for use in high-current injector applications. However, as is well known in the art, in high-current injector applications, steps need to be taken to minimize contamination of the cathode element due to out-gassing. Conventionally, these steps include treating the input surface of the diamond element to reduce out-gassing, using a cathode material that is less susceptible to out-gassing contamination and pumping the injector chamber during operation to evacuate the contaminating gases produced by the diamond element. As discussed above, the present invention preferably utilizes a GaN cathode element that is less susceptible to out-gassing contamination.

In the case of metal cathodes, the laser cleaning of the cathode can be performed prior to soldering the cathode to the diamond/ceramic unit. The capsule is designed such that with minimal modification, the assembly can be inserted into any of the RF injectors that are currently operational. This capsule can be used to increase the electron beam current in ATF, SDL, LEAF (all at BNL), LCLS at SLAC, FLASH at DESY, Germany and in many other existing facilities. It can also be incorporated in numerous FEL, ERL facilities that are being considered for construction.

Although preferred embodiments of the present invention have been described herein with reference to the accompanying drawings, it is to be understood that the invention is not limited to those precise embodiments and that various other changes and modifications may be affected herein by one skilled in the art without departing from the scope or spirit of the invention, and that it is intended to claim all such changes and modifications that fall within the scope of the invention.

The invention claimed is:

1. A method for fabricating a diamond amplified cathode capsule for generating an electron beam of secondary electrons, the method comprising:

providing a cathode element having a primary emission surface adapted to emit primary electrons;

providing an annular insulating spacer;

providing a diamond window element comprising a diamond material and having a secondary emission surface adapted to emit secondary electrons in response to primary electrons impinging on the diamond window element;

stacking a first high-temperature solder blank between the diamond element and the annular insulating spacer;

heating the first high-temperature solder blank under vacuum to form a weld between the diamond element and the annular insulating spacer thereby forming a welded diamond element and annular insulating spacer sub-unit;

stacking a second high temperature solder blank between the cathode element and the welded diamond element and annular insulating spacer sub-unit;

sealing off the diamond element from the second high temperature solder blank; and heating the second high temperature solder blank under vacuum to form a weld between the cathode element and the welded diamond element and annular insulating spacer sub-unit, thereby forming a vacuum encapsulated, diamond amplified cathode capsule with a hermitically sealed chamber defined therein, wherein the diamond element is protected from out gassing from the second high temperature solder blank during said second heating due to said sealing off of the diamond element.

2. A method as defined in claim 1, further comprising coating interface surfaces of the cathode element, the annular insulating spacer and the diamond window element with a metallic wetting material, the metallic wetting material being in contact with the first and second solder weld blanks to promote atomic adhesion therebetween.

3. A method as defined in claim 2, wherein the metallic wetting material is coated on the interface surfaces by a vacuum sputtering process.

4. A method as defined in claim 1, wherein providing the diamond window element comprises:

forming a diamond base;

metalizing one face of the diamond base;

vacuum sputtering a wetting material on an outer peripheral rim of the diamond base to form a wetting material coated diamond base;

cleaning the coated diamond base through abrasion; and etching the coated diamond base.

5. A method as defined in claim 1, wherein the cathode element comprises a photo-sensitive material such that the cathode element forms a photocathode element.

6. A method as defined in claim 1, wherein the welded diamond element and annular insulating spacer sub-unit is loaded in an alignment locking mechanism prior to said second heating, the lock mechanism including a sealing element for sealing the diamond element during said second heating.

7. A method as defined in claim 6, wherein the welded diamond element and insulating spacer sub-unit is retained within a clamp member of the alignment locking mechanism, the clamp member further providing a heat sink for preventing the weld between the diamond element and the annular insulating spacer from melting during said second heating.

8. A method as defined in claim 1, wherein the first and said second high temperature solder blanks are heated to about 370° C.

* * * * *